United States Patent [19]

Hanning et al.

[11] Patent Number: 4,764,646

[45] Date of Patent: Aug. 16, 1988

[54] DISTRIBUTOR CAP WITH ADJUSTABLE CONTACTS

[76] Inventors: H. Chris Hanning, 2029 Terracina Cir., Spring Valley, Calif. 92077; Gary J. Anderson, P.O. Box 1805, La Mesa, Calif. 92044

[21] Appl. No.: 95,644

[22] Filed: Sep. 14, 1987

[51] Int. Cl.[4] ..... H01H 9/00; H01H 19/00

[52] U.S. Cl. ..... 200/19 DC; 200/281

[58] Field of Search ..... 200/19 R, 19 DC, 19 DR, 200/24, 30 A, 30 AA, 31 A, 238, 249, 259, 280, 281, 285, 286, 287; 439/130

[56] References Cited

U.S. PATENT DOCUMENTS

| | | | |
|---|---|---|---|
| 1,337,329 | 4/1920 | Schafer | 200/19 DC |
| 1,745,077 | 1/1930 | Chryst | 200/19 DC |
| 1,782,939 | 11/1930 | Reis | 200/19 DC |
| 1,996,440 | 4/1935 | Sherman | 200/19 DC |
| 3,542,976 | 11/1970 | Moray | 200/19 DC |

*Primary Examiner*—J. R. Scott

*Attorney, Agent, or Firm*—Charmasson & Holz

[57] ABSTRACT

In a distributor cap for internal combustion engines, a multi-positionable contact which can be manually rotated to successively present each of a plurality of contact surfaces to the distributor arm after an adjacent contact surface has become pitted, corroded or otherwise worn; thus increasing the useful life of the distributor cap. The contact surfaces are symmetrically arranged about the axis of rotation of the contact. Rotation can be achieved by means of a screwdriver blade introduced through the sparkplug wire terminal to act on a slotted head of the rotating contact exposed at the bottom of the sparkplug wire terminal, or by grasping the contact from underneath.

7 Claims, 1 Drawing Sheet

PRIOR ART
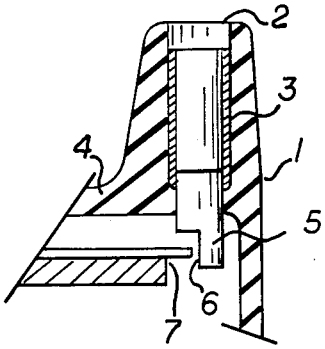
FIG. 1
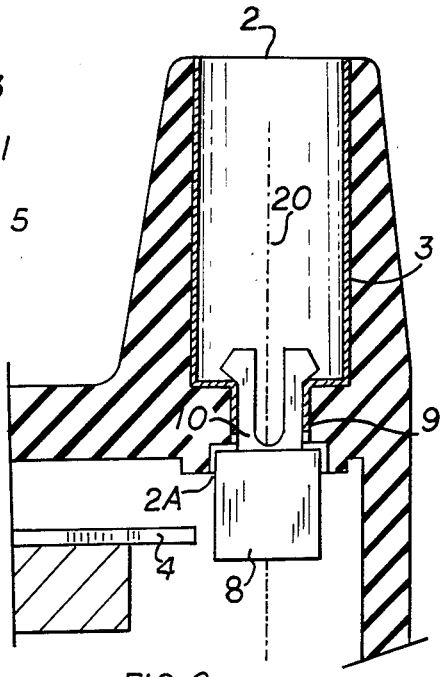
FIG. 2
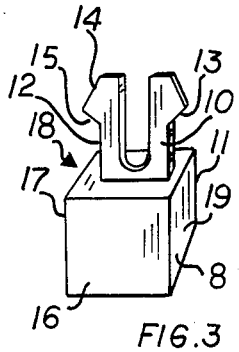
FIG. 3
FIG. 5
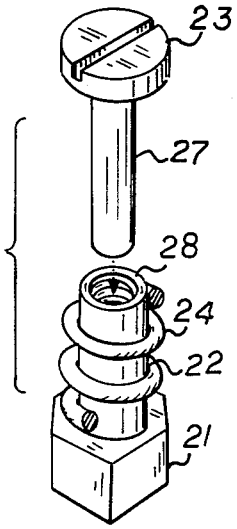
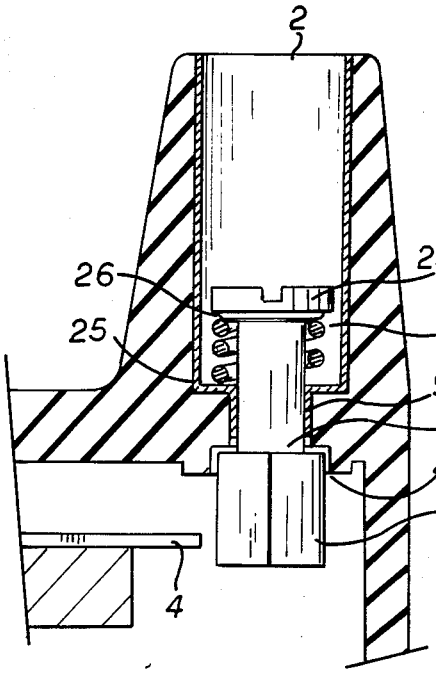
FIG. 4

DISTRIBUTOR CAP WITH ADJUSTABLE CONTACTS

BACKGROUND OF THE INVENTION

This invention relates to distributor caps for internal combustion engines.

The distributor cap of an internal combustion engine constitutes one of those disposable parts which are replaced during tuneup and other routine maintenance of the engine. The distributor, among other tasks, receives a surge of ignition current from the coil on a connector at the center of the cap, and distributes this surge of current by way of a rotating arm which successively addresses a plurality of peripheral contacts each connected to a sparkplug wire connector placed on the periphery of the top of the cap. The rotating arm does not physically touch the contact. The discharge of the current is done by arcing between the end of the arm and each contact across a very narrow gap. The performance of the engine is greatly affected by the pitting, and fouling of the contact area which necessarily results from the continuous arcing action on the contacts. It would therefore be advantageous to be able to replace the contacts between tuneups in order to get the maximum efficiency from the engine. It would also be advantageous to avoid replacing the distributor cap with each scheduled maintenance of the engine.

In most electrical switches the electrical contact surfaces of two elements are usually kept clean by the wiping action of a moving arm against a stationary terminal. Sometimes this is accompanied by a rotation of the stationary terminal under the whipping action of the arm as is disclosed in U.S. Pat. No. 2,387,961 to Wihanto. However in a distributor, such a wiping and whipping action is not available due to the gap which remains between the rotating arm and the peripheral contacts. U.S. Pat. No. 2,230,737 to Wilde suggests another approach where a terminal can be made with a plurality of symmetrical faces which can be electively exposed to the passage of the arm in order to increase the life and performance of the switch.

SUMMARY OF THE INVENTION

The principal and secondary objects of the invention is:

- to provide a means for extending the life and performance of a distributor cap in an internal combustion engine;
- to offer a type of distributor cap contact which can be rotated to present a new contact surface to the distributor arm once an adjacent contact surface has become pitted or contaminated; and
- to provide a means for quickly and conveniently rotating said contact.

These and other objects are achieved by way of a multi-positionable contact which can be manually rotated to successively expose a series of contact surfaces to the distributor arm.

BRIEF DESCRIPTION OF THE DRAWING

FIG. 1 is a cross-sectional view of the upper end corner of a distributor cap describing the prior art;

FIG. 2 is such a cross-sectional view showing a first embodiment of the invention installed therein;

FIG. 3 is a perspective view of the first embodiment of a rotatable contact;

FIG. 4 is a cross-sectional view of an upper corner of a distributor cap showing a second embodiment of the invention implemented therein; and FIG. 5 is an exploded perspective view of the second embodiment of a rotatable contact.

DESCRIPTION OF THE PREFERRED EMBODIMENTS OF THE INVENTION

There is shown in FIG. 1 an example of distributor cap contact arrangement currently in use throughout the industry. The drawing shows a cross-section of the upper corner of a distributor cap 1 taken across a sparkplug wire connector. This connector is formed as a cup 2 lined with a conductive sleeve 3 which is dimensioned to tightly engage the end of a sparkplug wire. The conductive sleeve 3 extends through the roof 4 of the cap to form a contact 5 which projects slightly into the inner space of the cap. The sleeve 3 and contact 5 are rigidly embedded in the insulating material which forms the roof 4 of the cap 1. The contact 5 presents a surface 6 to the distributor rotating arm 7 that receives from that arm an arcing discharge of ignition current to be sent to the corresponding sparkplug. When the contact surface 6 becomes pitted or contaminated due to repeated discharge of currents thereagainst, the whole distributor cap must be replaced.

Turning now to FIGS. 2 and 3 there is shown a first embodiment of the invention wherein the static contact 5 of the prior art has been replaced by a moveable terminal 8. The sleeve 3 of the cup 2 extends downward to line a bore 9 forming a socket that receives a bifurcated prong 10 which is integral with the contact section 11 of the terminal 8. Each of the two branches 12 and 13 of the bifurcated prong 10 terminates into a head with slanted edges 14 and 15 which facilitate the insertion and removal of the prong into the bore 9. The two branches 12 and 13 are designed to bend slightly inwardly under the pressure applied by the edges of the bore 9 against the slanted edges 14 and 15, and to return to their normal configuration after insertion as shown in FIG. 2. The contact section 11 has a generally parallelipipedic shape which creates four contact surfaces 16, 17, 18 and 19 which are symmetrically positioned in relation to the axis 20 passing through the center of the cup 2 and bore 9. It can now be understood that the terminal 8 can be installed on the distributor cap 1 in four separate orientations each offering one of its contact surfaces 16, 17, 18 or 19 to the rotating arm 4. A shallow recess 2A in the undersurface of the cap is provided coaxially with the terminal, and is shaped and dimensioned to closely nest the upper portion of the contact section 11. This nesting helps in properly orienting the contact section and contributes to its stability once the prong 10 has been fully inserted into the bore 9.

A second embodiment of the invention is illustrated in FIGS. 4 and 5. This embodiment is characterized by a hexagonal contact section 21 which offers six independent contact surfaces instead of the four exhibited by the first embodiment of the invention. A rod 22 extends axially from the contact section 21 through the bore 9 and into the cup 2. A slotted head 23 captures a coil spring 24 which is biased between the bottom 25 of the cup 2 and the underside 26 of the slotted head 23. FIG. 5 illustrates how the head 23 is assembled by force-feeding the tail 27 into an axial bore 28 in the rod 22. An hexagonal shallow nesting area 29 is provided in the underside of the distributor cap to position and stabilize the terminal in the manner described in connection with the first embodiment of the invention. The terminal can be rotated by inserting the blade of a screwdriver through the top of the cup 2 and pushing against the spring 24 or by grasping the contact section 21 with fingers and pulling to dislodge the upper part of the contact section 21 from the nesting area 29. The terminal can then be rotated until the desired contact surface is oriented toward the distributor arm 4.

It should be understood other forms of connection between the cup 2 receiving the sparkplug wire and the rotating contact section could be devised within the spirit of the invention. It should also be understood that the number of contact surfaces that might be practically implemented may also be different from those disclosed in the drawing.

While we have described the preferred embodiments of the invention and suggested some modifications, other embodiments may be devised without departing from the spirit of the invention and the scope of the appended claims.

What is claimed is:

1. In a distributor cap for internal combustion engines, wherein at least one terminal is positioned to intermittently establish a flow of ignition current with an arm passing in close proximity of the terminal, said terminal extending from inside said cap through a bore into the roof of said cap beyond its undersurface and making electrical contact with a cup formed above said roof, said cup being shaped and dimensioned to receive the end of a sparkplug wire; the improvement which comprises:

said terminal having a contact section shaped to form a plurality of contact surfaces;

said surface being symmetrically disposed about an axis passing through the center of said terminal;

a socket in electrical contact with said cup; and a prong in electrical contact with said section, said prong being shaped and dimensioned to engage said socket and to rotate axially therein in a plurality of selectable orientations which successively orient each one of said contact surfaces towards said arm.

2. The improvement of claim 1, wherein:

said socket comprises a tubular member extending axially from the bottom of said cup through said bore; and said prong comprises a rod extending axially from said section through said tubular member and means for orienting said prong, contact section and contact surfaces to successively orient each one of said surfaces toward said arm.

3. The improvement of claim 2, wherein said means for orienting comprises a slotted head at the end of said rod shaped and dimensioned to be rotated by means of a screwdriver blade introduced through said cup.

4. The improvement of claim 2, wherein said means for orienting comprises a head at the end of said rod; and a coil spring coaxially biased around said rod between said head and the bottom of said cup, said spring urging said section against the undersurface of said cap.

5. The improvement of claim 4, wherein the undersurface of said cap has a shallow cavity coaxial with said rod, said cavity being shaped and dimensioned to nest an upper end portion of said contact surfaces.

6. The improvement of claim 4, wherein said contact section has a polygonal cross-section.

7. The improvement of claim 6, wherein said contact section has a hexagonal cross-section forming six symmetrical contact surfaces.

* * * * *